US006419126B2

(12) United States Patent
Righolt

(10) Patent No.: US 6,419,126 B2
(45) Date of Patent: Jul. 16, 2002

(54) SPREADING DEVICE FOR SPREADING FLUIDS, AND DEVICE FOR DELIVERING AND APPLYING FLUID, ESPECIALLY ADHESIVE

(75) Inventor: Hendrik-Jan Righolt, Oosterhout (NL)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/855,965

(22) Filed: May 15, 2001

(30) Foreign Application Priority Data

May 16, 2000 (DE) ..... 100 23 673

(51) Int. Cl.[7] ..... B65D 88/54
(52) U.S. Cl. ..... 222/330; 222/504
(58) Field of Search ..... 222/330, 504

(56) References Cited

U.S. PATENT DOCUMENTS

| | | | | | |
|---|---|---|---|---|---|
| 4,488,665 | A | * | 12/1984 | Cocks et al. | 222/504 |
| 4,891,249 | A | | 1/1990 | McIntyre | 427/421 |
| 4,983,109 | A | | 1/1991 | Miller et al. | 425/7 |
| 5,000,112 | A | | 3/1991 | Rothen et al. | 118/411 |
| 5,145,689 | A | | 9/1992 | Allen et al. | 425/72.2 |
| 5,172,833 | A | * | 12/1992 | Faulkner, III | 222/504 |
| 5,236,641 | A | | 8/1993 | Allen et al. | 264/40.1 |
| 5,382,312 | A | | 1/1995 | Raterman | 156/500 |
| 5,418,009 | A | | 5/1995 | Raterman et al. | 427/207.1 |
| 5,421,921 | A | | 6/1995 | Gill et al. | 156/62.4 |
| 5,421,941 | A | | 6/1995 | Allen et al. | 156/244.11 |
| 5,445,674 | A | | 8/1995 | DeMars | 118/669 |
| 5,540,804 | A | | 7/1996 | Raterman | 156/500 |
| 5,556,471 | A | | 9/1996 | Boccagno et al. | 118/300 |
| 5,605,720 | A | | 2/1997 | Allen et al. | 427/288 |
| 5,618,566 | A | | 4/1997 | Allen et al. | 425/7 |
| 5,620,139 | A | | 4/1997 | Ziecker | 239/124 |
| 5,636,790 | A | | 6/1997 | Brusko et al. | 239/124 |
| 5,679,379 | A | | 10/1997 | Fabbricante et al. | 425/7 |
| 5,683,752 | A | | 11/1997 | Popp et al. | 427/421 |
| 5,728,219 | A | | 3/1998 | Allen et al. | 118/315 |
| 5,862,986 | A | | 1/1999 | Bolyard, Jr. et al. | 239/135 |
| 5,875,922 | A | * | 3/1999 | Chastine et al. | 222/504 |
| 5,950,875 | A | * | 9/1999 | Lee et al. | 222/504 |
| 6,089,413 | A | | 7/2000 | Riney et al. | 222/318 |
| 6,210,141 | B1 | | 4/2001 | Allen | 425/7 |
| 6,220,843 | B1 | | 4/2001 | Allen | 425/7 |
| 6,296,463 | B1 | | 10/2001 | Allen | 425/7 |

* cited by examiner

*Primary Examiner*—Philippe Derakshani
(74) *Attorney, Agent, or Firm*—Wood, Herron & Evans, L.L.P.

(57) ABSTRACT

The present invention pertains to a spreading device for spreading fluids, especially for devices for applying adhesives, with a distributing block which has a fluid canal and an inlet opening for introducing fluid into the fluid canal and an outlet opening for discharging fluid from the fluid canal. At least two distributing blocks may be positioned and fixed adjacent to each other in such a way that the fluid canals of adjacent distributing blocks are connected to each other, so that fluid can flow from the fluid canal of one distributing block into the fluid canal of the adjacent distributing block.

10 Claims, 5 Drawing Sheets

SPREADING DEVICE FOR SPREADING FLUIDS, AND DEVICE FOR DELIVERING AND APPLYING FLUID, ESPECIALLY ADHESIVE

FIELD OF THE INVENTION

The present invention pertains to a device for spreading fluids, especially adhesives, with a distributing block which has a fluid canal and an inlet opening for introducing fluid into the fluid canal and an outlet opening for discharging fluid from the fluid canal. The invention pertains further to a device for delivering and applying fluid, especially adhesive, with a fluid canal formed in a main body, which can be connected to a source of fluid and which discharges through an outlet opening for delivering the fluid.

BACKGROUND OF THE INVENTION

Devices for delivering and applying fluids, such as hot-melt glue, are utilized in various branches of industry. The liquid adhesive is transported from a source of adhesive, for example a container filled with adhesive, to several devices, arranged, for example, side-by-side in a row, which are also referred to as applicator modules, applicator heads or applicators. Each applicator module has an individually controllable application valve, so that the flow of adhesive in the fluid canal and thus in the outlet opening can be influenced and applied to a substrate which is moving relative to the device, such as a sheet of packaging material or the like, in conformity with a desired application pattern. If a number of applicators are arranged side-by-side, for example, so that adhesive can be laid down on a substrate in a number of adjacent rows, the applicators are normally fed from a common source of fluid. For this purpose, the applicators may be supplied with fluid by means of a distribution device such as disclosed in German utility model DE 299 07 968.6 U1, which derives from the present application. German utility model DE 299 07 968.6 U1 discloses a fluid canal formed in a distributing block, and individual canals which communicate with the fluid canal leading to the individual applicators, which are screwed onto the distributing block.

The disadvantage in the device disclosed in German utility model DE 299 07 968.6 is that the distributing block must be produced with its length designed for a specific number of applicators arranged side-by-side. Modification of the entire application system in the event that the number of attached applicators is to be changed is relatively complex. Lengthening the distributing block, in particular, is not possible without great engineering effort. Alternatively, individual hoses can lead from a source of fluid to the individual applicators. The disadvantage in such a device is that the complexity is relatively great when a large number of hoses leading to the applicators are used, and the hoses can interfere with operation.

The present invention provides a spreading device and an applicator which largely avoids the disadvantages of the current state of technology and can be manufactured easily and used flexibly.

SUMMARY OF THE INVENTION

The present invention solves this problem by providing a spreading device having at least two distributing blocks which can be positioned and fixed adjacent to each other in such a way that the fluid canals of adjacent distributing blocks are connected with each other in such a way that fluid from the fluid canal of one distributing block can flow into the fluid canal of the adjacent distributing block. The invention solves this problem further with several applicators which may be supplied with fluid by means of adjacent distributing blocks which can be coupled with each other.

With the present invention it is possible to assemble an individually structured apparatus made up of modules for a particular application, out of separate prefabricated distributing blocks. The distributing blocks, which are preferably identical in design, can be put together individually, for example, for a number of applicators arranged side-by-side in a row for delivering and applying adhesive to substrates. A complex application using a number of hoses can be avoided with the present invention. Furthermore, the apparatus of the present invention can be altered easily at any time, varying its length for example, if additional connections or additional applicators need to be attached. This results in great flexibility and versatility.

To enable the use of multiple applicators, the spreading device of the present invention may be refined in that the fluid canal of a distributing block has an additional outlet opening. The distributing block can then be attached to an adjacent element with a flow canal, especially an adhesive applicator, in such a way that fluid can flow from the additional outlet opening into the flow canal of the additional element. Fluid is conveyed into an adjacent distributing block through the first outlet opening, and is conducted into an adhesive applicator for example through the additional outlet opening.

In an alternative special implementation of the present invention, a connecting adapter is positioned at least partially inside a distributing block and has a flow canal for the fluid. The flow canals of adjacent adapters are connected with each other when the apparatus is in its assembled state. With the help of the connecting adapters, a spreading device can be built according to need and later adapted, with the help of prefabricated identical elements. The individual adapters can be inserted easily into cutouts or drilled holes in a distributing block and connected with each other.

In accordance with the present invention the adapter has a centering piece for centering on the distributing block. When the unit is assembled the centering piece is positioned partly in a drilled hole in one distributing block and partly in a drilled hole in an adjacent distributing block. Such a centering piece allows the adapter to be positioned, and adjacent distributing blocks to be centered relative to each other. The spreading device can easily be built up in modular fashion. In accordance with a further refinement grooves on the centering piece receive sealing rings to seal the centering piece with respect to the distributing block.

In accordance with an alternative implementation, a pipe section is formed on each adapter. The pipe section may be inserted into a drilled section of an adjacent adapter, so that the flow canal of one adapter is connected to the flow canal of an adjacent adapter. For connection to applicators which are to be fed with fluid by means of the spreading device, it is preferable that there be a radial hole drilled through the pipe section, though which fluid can flow into a fluid canal of a distribution block which is in the form of a ring canal.

The adapter is essentially rotationally symmetrical, with the centering piece having a larger outside diameter than the pipe section and containing a drilled section to receive the pipe section of an adjacent adapter.

According to an alternative implementation, adjacent distributing blocks are easily fixed and/or secured to each other using cutouts and/or projections on the distributing blocks. Adjacent distributing blocks may be joined in positive-fit connections with the cutouts and/or projections. A simple variant of this implementation calls for the cutout to be in the form of a longitudinal slot and the projections to be a longitudinal elevation. This prevents the distributing blocks from rotating relative to each other. The positive fit connection could also be realized in the form of a so-called dovetail guide, with projections and cutouts which engage each other.

In an additional preferred implementation the distributing blocks can be connected by means of a threaded connection to the applicator which delivers and applies fluid to a substrate. A number of holes may be drilled through each distributing block, through which threaded screws can be inserted and screwed into threaded holes in the adjacent applicator.

If the distributing blocks are of essentially identical design, the communicating fluid canals can easily be terminated by having the fluid canal of one distributing block closed on one side by means of a cover which can be screwed into a threaded hole in the distributing block.

Additional advantageous refinements are evident from the following description of the accompanying drawings. The figures show the following:

DETAILED DESCRIPTION OF THE INVENTION

Figure 1:
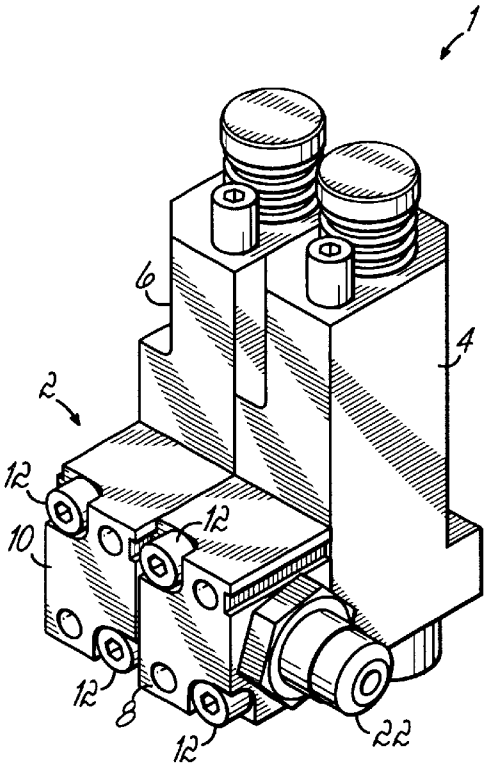
FIG. 1 is a perspective view of an application and spreading device in accordance with the present invention.
Figure 6:
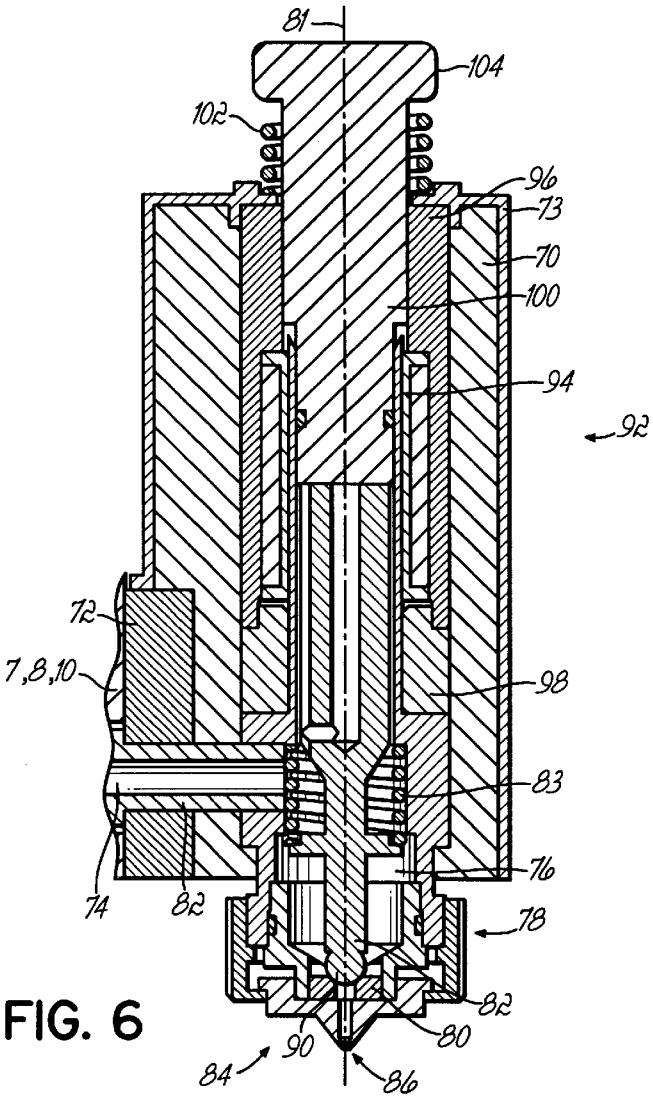
FIG. 6 is a cross-sectional view of an applicator in accordance with FIG. 1.

FIG. 1 shows an apparatus 1 in accordance with the present invention for applying fluids, together with a spreading device 2 in accordance with the present invention. The apparatus 1 serves to deliver and apply adhesive or other fluid materials to any desired substrate. The apparatus 1 is part of an application system which includes a source of material in the form of a container, a transport pump, lines, and controllers (not shown) for controlling and regulating individual components of the application system. Two application heads or application modules 4, 6, whose construction is illustrated in FIG. 6 and described in greater detail below, are connected to the spreading device 2. The spreading device 2 supplies the application heads 4, 6 with adhesive. Of course other fluids can also be distributed and applied in accordance with the present invention.

Figure 3:
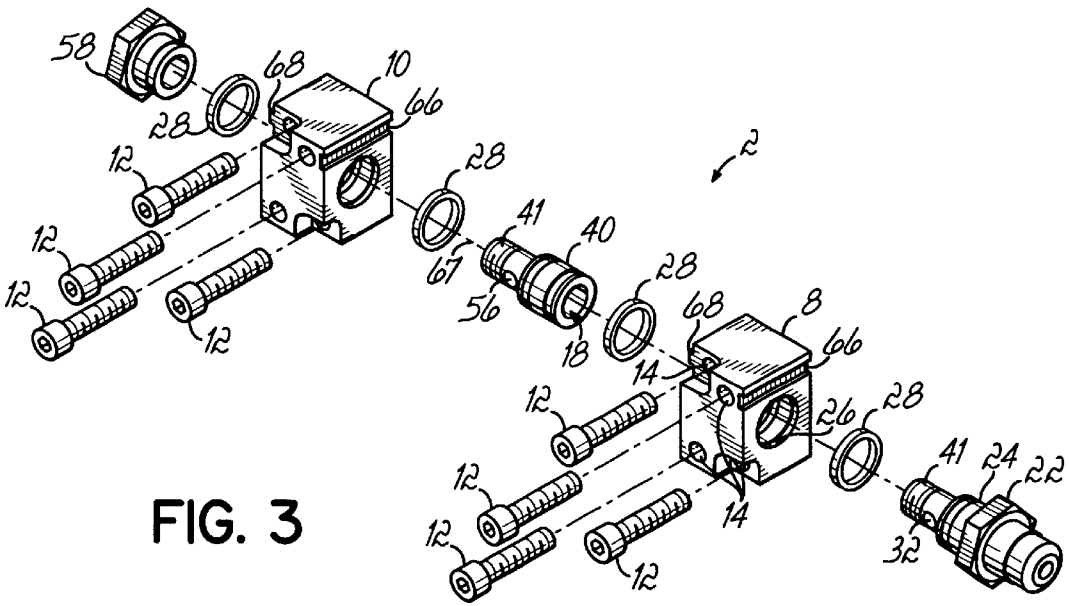
FIG. 3 is an exploded view of an additional sample implementation of a spreading device.

The spreading device 2 is shown in FIG. 1 in its assembled state and shown in FIG. 3 in a disassembled state. The spreading device 2 has two distributing blocks 8, 10 of identical design, which are positioned immediately adjacent to each other and are screwed together with the application modules 4 and 6, respectively. As will be explained in greater detail below, each distributing block 8, 10 has an internal fluid canal with an inlet opening for introducing fluid and an outlet opening for carrying off fluid.

Figure 2:
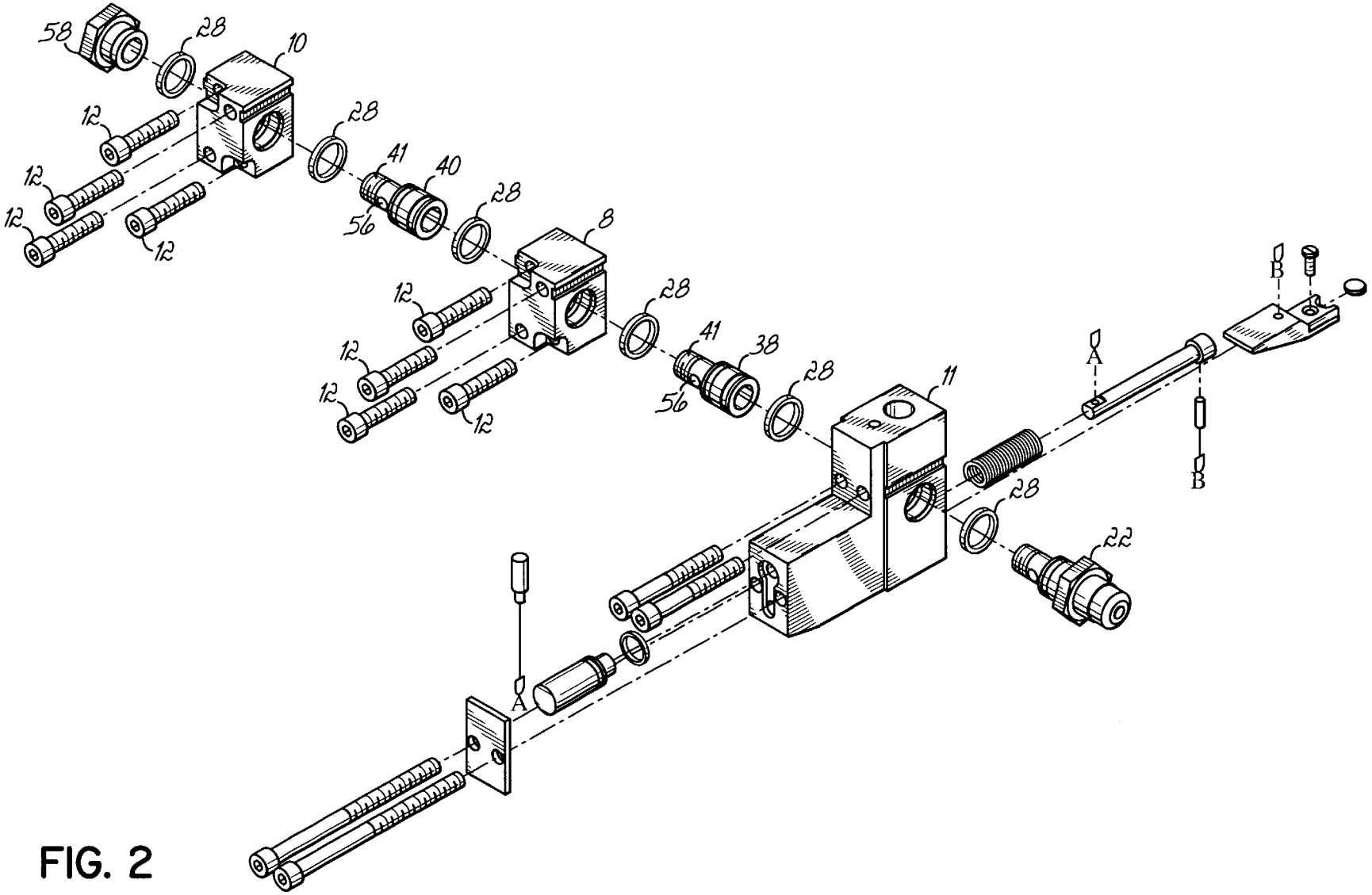
FIG. 2 is an exploded view of an additional sample implementation of a spreading device in accordance with the invention.
Figure 4:
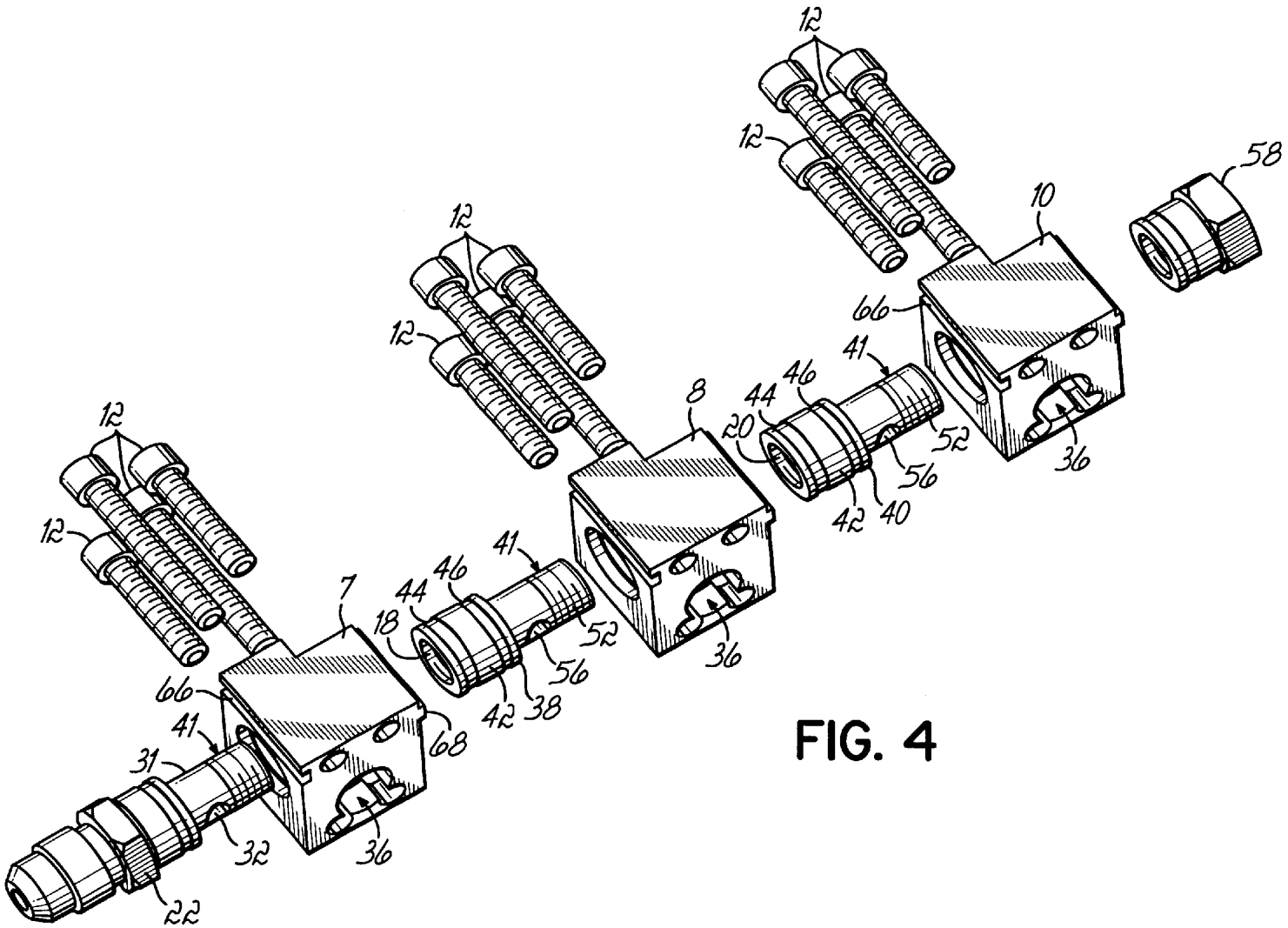
FIG. 4 is an exploded view of an additional sample implementation of a spreading device.
Figure 5:
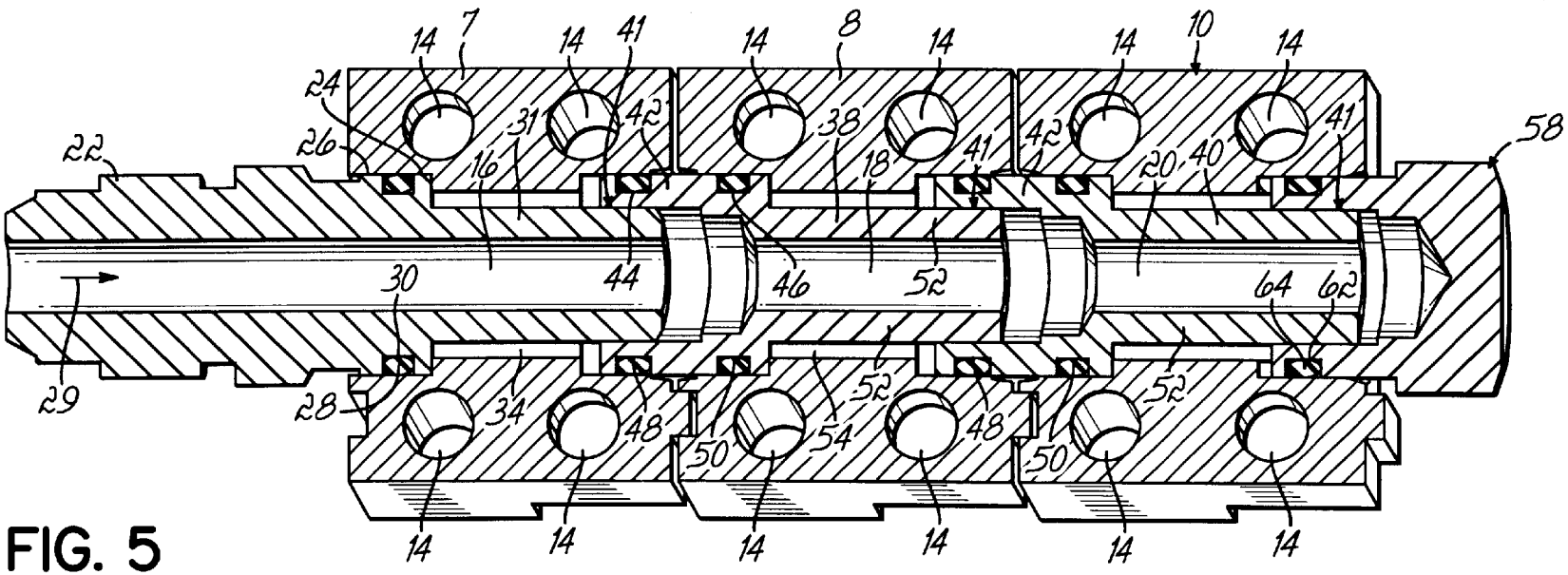
FIG. 5 is a cross-sectional view of the spreading device in FIG. 4 in assembled condition, along a vertical sectional plane.

The sample implementations of the spreading device shown in FIGS. 2 and 4, respectively, differ from the implementation shown on the basis of FIGS. 1 and 3 primarily in the number of distributing blocks. The variant according to FIG. 2 has three distributing blocks 8, 10, 11. The sample implementation shown in FIG. 2 is used for connecting two adjacent applicators 4, 6; the distributing block 11 is a custom-made item whose purpose is not significant for the present invention. The sample implementation 3 illustrated in FIGS. 4 and 5 has identical distributing blocks 7, 8, 10; it is used for attaching three series-connected application modules. For equivalent and essentially equivalent parts of all sample implementations the same reference symbols are used, and the descriptions above and following apply identically or correspondingly.

Attachment of the distributing blocks to the application modules is accomplished by four threaded screws 12 per distributing block 8, 10, which are inserted through holes 14 drilled through the distributing blocks 8, 10 and are screwed into threaded holes in the main body of the application modules 4, 6.

As FIG. shows, in the assembled state, adjacent distributing blocks 7, 8, and 10 are arranged and fixed relative to each other in such a way that fluid canals 16, 18, 20 are connected to each other so that fluid can flow from the fluid canal of one distributing block into the fluid canal of the adjacent distributing block. Furthermore, each fluid canal 16, 18, 20 in this sample implementation has an additional outlet opening for each distributing block 7, 8, 10, through which the fluid can flow into the flow canal of an additional part; in the example into the supply canal of an application module (see FIG. 6).

A hose connection adapter 22, see FIGS. 1, 2, 3 and 4, is connected on one side in a manner not shown with a hose, which in turn is connected to source of fluid, and on the other side is inserted by means of a cylindrical centering piece 24 into a cylindrical hole 26, for example by being screwed in or pressed in. An 0-ring 28, which is inserted into a slot 30 (see FIG. 5) on the centering piece 24, provides a seal between the hose connector 22 and the distributing block 7, 8, 11 when the unit is assembled. The hose connection adapter 22 also has a pipe section 31 (see FIG. 5), which is positioned entirely inside the distributing block 7. Fluid can flow in through the fluid canal 16 formed inside of the hose adapter connection 22 in the direction of the arrow 29. A radial hole 32 is drilled through the hose connection adapter 22, through which the fluid can flow into a ring chamber 34 (see FIG. 5). This communicates with a drilled hole 36, shown in FIG. 4, which leads into the outlet opening of the fluid canal of a distributing block 7, 8, 10, 11; the hole 36 in turn is connected with the supply canal of the application modules 4, 6, so that fluid can enter into the supply canal and the outlet canal of the application modules 4, 6.

There is/are one or more connecting adapter(s) 38, 40 positioned at least partially inside a distributing block 7, 8, 10, 11 and fixed therein. Each adapter 38, 40 has a flow canal or fluid canal 18, 20, and adjacent adapters 38, 40 are positioned relative to each other in such a way that the flow canals 18, 20 are connected with each other, so that fluid can flow through. As can be seen from FIG. 5, the flow canal 18 of the adapter 38 communicates with the fluid canal 16 of the hose connection adapter 22.

Each adapter 38, 40 has a centering piece 42, which is located partially in a cylindrical hole in one distributing block and partially in a cylindrical hole in an adjacent distributing block. Two grooves 44, 46 with a space between them receive 0-rings 48, 50 to provide a seal against the distributing block.

Connected to each centering piece 42 is a cylindrical pipe piece 52, which has a smaller diameter than the centering piece 42 and can be inserted into an internal hole in the adjacent centering piece 42 of the adjacent adapter. The end of the pipe section 52 of an adapter 38, 40 has male threading 41 which matches with female threading in the internal hole of the centering piece 42. A press-in connection can also be used in place of a threaded connection. The hose connection adapter 22 also has male threading 41, which can be screwed into female threading in an adjacent adapter 38. At the same time, when the unit is assembled there is a ring canal 54 formed between the pipe section 52 and the corresponding distributing block 8, 10, which connects to the hole 36 in a manner similar to the ring chamber 34 in order to conduct fluid from the distributing block. There is a radial, cylindrical through hole 56 in each pipe section 52 for this purpose.

In a distributing block 10 which is the last in a row of several distributing blocks, a cover 58 is screwed in by means of threads or pressed in, to close off the fluid canal 20. The cover 58 is inserted into a cylindrical hole in a distributing block 10 with a sealing section 60, and is sealed by means of an 0-ring 64 which is placed in a groove 62. The sealing section 60 of the cover 58 has female threading which engages the male threading 41 of the adjacent adapter 40.

On one side of the distributing blocks 7, 8, 9, 10, 11 are cutouts 66 in the form of longitudinal slots, and on the other side corresponding projections 68 in the form of longitudinal elevations; these form a positive-fit connection when the unit is assembled, so that the distributing blocks cannot rotate relative to each other around a central axis 67 (FIG. 3). Alternatively, dovetail connections or other positive-fit connections could be used which would also prevent axial shifting of the distributing blocks relative to each other.

As can be seen from FIG. 6, an applicator module 4, 6 has a main piece 70 of cast synthetic material. The main piece 70 is surrounded by a housing 73. A supply canal 74 which is connected to the source of material communicates with an outlet canal 76. The distributing blocks 7, 8, 10 are screwed onto the sides by means of a spacer plate 72. As explained earlier, fluid material can flow through the distributing blocks 7, 8, 10 into the supply canal 74 and into the outlet canal 76 when a valve system 78 is in its open position. The supply canal 74 is formed inside of a sleeve 82 which is positioned radially in relationship to a longitudinal axis 81.

The valve system 78 comprises a valve seat 80 and a valve body 82 which can move relative to the valve seat 80, and a tensioning device in the form of a coil spring 83 for pre-tensioning the valve body in the direction of closure. The valve seat 80 is part of a nozzle system 84. The nozzle system 84 also includes an outlet opening 86 for delivering the fluid.

The valve body 82, which is in the form of a longitudinal needle, is mounted axially in the direction of the longitudinal axis 81 so that it can be moved back and forth translationally, and can be moved from an open position in which a ball-shaped lower section 90 is not in contact with the valve seat 80, so that a free flow section results, into a closed position in which the ball-shaped section 90 is in contact with the valve seat 80. The coil spring 83 pre-tensions the valve body 82 in the direction of the closed position. The outlet canal 76 which is formed in a lower area of the main body 70 runs essentially in the axial direction with respect to the longitudinal axis 81, while the supply canal 74 runs radially to the longitudinal axis 81.

In a lower section of the main body 70, that is, on the side of the outlet opening 86, the supply canal 74 is connected with the outlet canal 76. The flow path between the area in which the supply canal 74 gives way to the outlet canal 76 and the outlet opening 86 is relatively short, so that only little pressure is lost. The tensioning device in the form of the coil spring 83 is also located in a lower section of the main body 70.

The drive unit 92 for moving the valve body 82 is an electromagnetic coil arrangement with a ring-shaped coil 94, which creates a magnetic field by means of which a force is exerted on the longitudinal, needle-shaped valve body 82 in the direction of the axis 81. Concentric to the coil 94 is an upper magnetizable sleeve-shaped flux ring 96. The coil 94 is adjoined at its lower end by an additional magnetizable lower flux ring 98.

A pole piece 100 is positioned partially inside the ring-shaped coil 94 and is likewise magnetically operative. The arrangement of the pole piece 100, the flux ring 96 and the flux ring 98 causes a strong magnetic field to be formed, so that a strong axial force can be applied to the valve body 82 in order to move it intermittently at high frequency from the open to the closed position and vice versa. At the same time the pole piece 100 is designed as an adjusting element 100 which can be moved relative to the main body 70 and arrested in various positions, forming a stop for the movable valve body 82, so that the stroke of the movable valve body is variable. For this purpose the pole piece or adjusting element 100 has male threads which engage female threads, so that when the pole piece 100 is rotated around the longitudinal axis 80 the pole piece 100 moves axially.

A pre-tensioning force is exerted on the pole piece 100 by means of a coil spring 102. The coil spring 102 is in contact with an extended grip section 104 which is knurled on its circumferential surface. The pole piece 100 can easily be turned manually by means of the grip section 104.

While the present invention has been illustrated by a description of a preferred embodiment and while this embodiment has been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims, wherein I claim:

What is claimed is:

1. A device for applying fluid to a substrate, comprising:

a pair of fluid applicators each operative to discharge fluid onto the substrate;

a first and a second distributing block each adapted to mount one of said fluid applicators, said first and said second distributing blocks each having a first fluid canal, an inlet opening for introducing fluid into said first fluid canal, a first outlet opening for discharging fluid from said first fluid canal, and a second outlet opening coupled in fluid communication with said fluid applicator, said first and said second distributing blocks being positioned and fixed adjacent to each other; and a connecting adapter positioned at least partially inside said first fluid canal of said first distributing block and said first fluid canal of said second distributing block, said connecting adapter having a second fluid canal that couples said first fluid canals of said first and said second distributing blocks into fluid communication with each other so that fluid can flow directly from said first outlet opening of said first fluid canal of said first distributing block through the second fluid canal of said adapter into said inlet opening of said first fluid canal of said second distributing block.

2. The device of claim 1, wherein said connecting adapter includes a centering piece containing a portion of said second fluid canal and adapted to center said adapter within said first fluid canals of said first and said second distributing blocks, such that when the device is assembled said centering piece is positioned partially inside said first fluid canal outlet of said first distributing block and partially inside said first fluid canal outlet of said second distributing block.

3. The device of claim 2, wherein said centering piece includes an outer surface with a plurality of slots each adapted to receive a sealing ring and a plurality of sealing rings each positioned in a corresponding one of said slots, each of said sealing rings sealingly engaging said first fluid canal of one of said first and said second distributing blocks.

4. The device of claim 2, wherein said first fluid canal has an inner diameter and each adapter includes a pipe section connected with said centering piece and extending through said first fluid canal, said pipe section having an outer diameter smaller than said inner diameter of said first fluid canal so that said pipe section is insertable into said first fluid canal, said pipe section containing a portion of said second fluid canal and further having a passageway coupling said second outlet opening in fluid communication with said second fluid canal.

5. The device of claim 4, wherein said outer diameter of said pipe section is smaller than said inner diameter of said first fluid canal so as to form a ring chamber coupling said passageway of said connecting adapter in fluid communication with said second outlet opening.

6. The device of claim 4, wherein said connecting adapter is rotationally symmetrical.

7. The device of claim 1, wherein said first distributing block includes a first side surface and a cutout recessed in said first side surface, said second distributing block includes a second side surface and a projection projecting from said second side surface, said projection of said second distributing block configured to engage said cutout of said first distributing block in a positive-fit connection for preventing relative rotation of said first and said second distributing blocks.

8. The device of claim 7, wherein said cutout is a longitudinal slot and said projection is a longitudinal elevation.

9. The device of claim 1, wherein said first and said second distributing blocks are configured so that said pair of fluid applicators are removably attachable thereto.

10. The device of claim 1, further comprising a cover adapted to close said first outlet opening of said first fluid canal of said second distributing block for terminating a fluid path provided collectively by said first and second fluid canals.

* * * * *